US009734806B1

(12) United States Patent
Storck

(10) Patent No.: US 9,734,806 B1
(45) Date of Patent: Aug. 15, 2017

(54) GUITAR PICK WITH INTEGRAL STRAP HOLDER

(71) Applicant: Kurt Storck, Farmington Hills, MI (US)

(72) Inventor: Kurt Storck, Farmington Hills, MI (US)

( * ) Notice: Subject to any disclaimer, the term of this patent is extended or adjusted under 35 U.S.C. 154(b) by 0 days.

(21) Appl. No.: 15/071,233

(22) Filed: Mar. 16, 2016

(51) Int. Cl.
*G10D 3/08* (2006.01)
*G10D 3/16* (2006.01)

(52) U.S. Cl.
CPC ..... *G10D 3/163* (2013.01)

(58) Field of Classification Search
CPC ..... G10D 3/08; G10D 3/163; G10G 5/005; G10G 5/00; G10G 7/00
USPC ..... 84/320–322
See application file for complete search history.

(56) References Cited

U.S. PATENT DOCUMENTS

2014/0076120 A1* 3/2014 Hollin, Jr. ..... G10D 3/163 84/322
2015/0122106 A1* 5/2015 Spivey ..... G10D 3/163 84/322

* cited by examiner

*Primary Examiner* — Kimberly Lockett
(74) *Attorney, Agent, or Firm* — Thomas P. Heed

(57) ABSTRACT

The present invention is a guitar pick with an integral strap holder. The present invention comes in a variety of embodiments. In one set of embodiments, a slot can be made in the guitar pick, for accommodating a guitar strap. In another set of embodiments, a breakaway shaft can be connected to the guitar pick. The breakaway shaft contains a toothed slot for accommodating a guitar strap.

13 Claims, 5 Drawing Sheets

GUITAR PICK WITH INTEGRAL STRAP HOLDER

FIELD OF INVENTION

This invention relates to the field of musical instruments, specifically to picking devices.

BACKGROUND OF INVENTION

The inventor of the present invention is also the inventor of U.S. Pat. No. 8,742,239 ("Patent '239"). The present invention is a different approach then Patent '239 to provide a guitar player a pick in a timely fashion. For the sake of clarity, the background of Patent '239 is repeated here, with appropriate modifications and additions.

Musicians who play stringed instruments, in particular guitars, use picks, also called plectrums. A pick is a small piece of thin plastic, metal, stone, bone, or other thin, rigid material, used to strum the strings of an instrument. Picks are usually, roughly speaking, triangular or teardrop in shape. The material, thickness, geometry, and tip of the pick affect the sonic characteristics of the instrument. For example, a really stiff, thick pick will have a very different sound from a thin, softer pick. The angle, depth, and direction of motion of the pick striking the strings is called the attack. The attack is individualized for each musician. Some musicians have quite an aggressive attack, striking the strings with a substantial portion of the pick, while using a locked thumb, putting quite a bit of force on the pick.

During extended playing, such as concerts, recording sessions or practices, stringed instrument musicians often find a need to use a new pick, for a variety of reasons. After playing for a while, a musician's hands may become sweaty or moist, making it more likely that the musician will drop or mishandle the pick. While rapidly strumming, many musicians lose their grip on their pick, and drop the pick. Additionally, due to the thin, brittle nature of picks, they tend to break during prolonged play, especially when used with an aggressive attack. Lastly, with extended play, the point of the pick can be rubbed away due to string friction. As the pick loses its point, it changes sonic characteristic and the attack on the string. Relatively speaking, thin and medium thickness picks tend to crack or break more than thicker ones.

Ideally, when a musician needs a new pick during a session, a pick should be available to the strumming hand of the musician, with no time lag. If the musician must stop to grab a pick, it can affect the quality of the concert or recording. Additionally, it can disrupt the group with whom the musician is practicing. An ideal pick holder would allow the musician to get a new pick with a quick, reliable movement, without interrupting playing. The solution should allow the musician to get a new pick a number of times. In other words, the solution should allow multiple picks to be presented in close proximity to the strumming hand, with relatively unfettered access.

Currently, when a musician needs a new pick during a session, they have a limited number of options. First, they can stop playing and get a new pick. Second, they can use their nails, instead of the pick. Third, they can use a deformed or partially broken pick, until they have a reasonable chance to replace the pick. Fourth, they can use one of the existing solutions for a pick holder. Fifth, they can use the invention described in Patent '239.

PRIOR ART REVIEW

None of the current solutions in the prior art are ideal. Some musicians use small, clear plastic bags to hold picks.

The musician will keep this bag nearby while playing. The problem with this solution is that the musician has to stop playing, pick up the bag, remove a pick, and resume playing.

Some musicians use pick-holder products that are designed to fit on the neck or headstock of the instrument near the tuning, such as the Wedgie Headstock Pick Holder. There are a substantial number of patents for pick holders mounted on or near the headstock, including the following: U.S. Pat. No. 1,784,934, by named inventor Johansson, entitled, "Plectrum holder" ("Johansson '934"); U.S. Pat. No. 5,127,300, by named inventor Silverman, entitled, "Pick holder for stringed musical instrument" ("Silverman '300"); and U.S. Pat. No. 6,639,136, by named inventor Judd, entitled, "Guitar pick holder" ("Judd '136"). The problem Johansson '934, Silverman '300, and Judd '136 is that, since the picks are stored on the headstock, the picks are presented, or made available, to the wrong hand of the musician. In order to access a new pick, the musician still needs to cease strumming the instrument, reach to the headstock with his or her strumming hand, and then resume playing.

Some musicians use pick holders that offers access to a spring-loaded stack of picks. The prior art contains many patents disclosing various types of spring loaded pick holders, including the following: U.S. Pat. No. 5,847,299, by named inventors Zovko, et. al., entitled, "Self-contained pick dispenser" ("Zovko '299"); U.S. Pat. No. 7,626,103, by named inventor Phillips, entitled, "Musical instrument pick holder" ("Phillips '103"); and U.S. Pat. No. 7,629,522, by named inventor Isaacson, entitled, "Stringed pick pincher" ("Isaacson '522"). Zovko '299, Phillips '103, and Isaacson '522 are sub-optimum for the same of reasons. First, the pick holder will respond to picks differently, based on the surface texture, thickness, and material of the pick. Many musicians have a wide variety of picks, with the picks coming in variety of hardnesses, thicknesses, and surface finishes. Spring loaded pick holders jam-up when loaded with textured picks. Additionally, thicker picks tend to be difficult to remove from spring loaded pick holders. Lastly, due to the varying thicknesses of picks, the spring loaded holders that stack the picks, such as Zovko '299, tend to dispense more than one pick when filled with thinner picks.

Some musicians use pick holders that retain the picks using some form of friction fit. The prior art contains many patents disclosing various types of pick holders that use friction fits to retain the pick, including the following: U.S. Pat. No. 5,299,485, by named inventor Denton, entitled, "Stringed instrument pick and slide holder" ("Denton '485"); U.S. Pat. No. 5,651,468, by named inventor Irizarry, entitled, "Holder for thin planar objects" ("Irizarry '468"); and U.S. Pat. No. 6,215,052, by named inventors Giddens, et. al., entitled, "Guitar pick holder" ("Giddens '052"). Denton '485, Irizarry '468, and Giddens '052 share a common cluster of problems. First, due to the retention force of the invention, the musician has to use two fingers to remove the pick. This means the musician's strumming hand must stop. Additionally, retention force varies greatly with the style, finish, and thickness of the pick. These types of pick holders make the musician prone to mishandling the pick, when attempting to remove one quickly.

Some musicians use pick holders that retain picks in a pocket, or pockets, sized to hold guitar picks. The prior art contains many patents disclosing various types of pick holders, pick slots, or both, including the following: U.S. Pat. No. 4,785,708, by named inventor (Stevie Ray) Vaughan, entitled, "Pick holder for stringed instruments" ("Vaughan '708"); U.S. Pat. No. 5,905,217, by named inventor Byers, entitled, "Pick holder" ("Byers '217"); U.S.

Pat. No. 6,472,590, by named inventor Kulik, entitled, "Arm sheath for use with a stringed instrument" ("Kulik '590"); and U.S. Pat. No. 8,097,799, by named inventor Tran, entitled, "Plectrum receptacle systems" ("Tran '799"). Just a raw pocket, roughly sized to fit a guitar pick, makes a poor pick holder. The pocket will fit some picks snuggly and other picks loosely. Some of the prior art tried to overcome this problems, such as Stephen Ray Vaughan's U.S. Pat. No. 4,758,708. This patent uses slots within each pocket to create proper retention force. The problem with Vaughan '708 is that it requires two fingers to remove a pick, precisely because it provides positive retention force. The Tran '799 also uses a retainer to forcibly hold the pick. Kulik '590 is for a pick holder sewn into a flexible arm sleeve. The flexible arm sleeve creates a force fit of the pick, while the flexible sleeve is being worn. In essence, these three patents are using a force fit in a pocket, which creates a variable retention force, and a retention force that requires, at a minimum, a finger and a thumb, to remove a new pick. Other pocket-based solutions, such as Byers '217, offer just a single pick in a pocket or sleeve.

U.S. Pat. No. 7,417,184, by named inventor Weathersby, entitled, "Portable guitar pick holder apparatus" ("Weathersby '184"), discloses a hybrid between a spring-loaded pick-holder and a pick-holder sleeve. Weathersby '184 teaches a spring-loaded pick-holder that has a strap, to wear on the arm while playing a guitar. Weathersby '184 has a plurality of openings, shaped so that a guitar pick can be partially revealed and partially concealed. Internal springs exerts a force on a stack of guitar picks. A portion of the outer-most guitar pick extends out of the pick-holder so that it can either be drawn out by the user, or it can be dispensed by use of a switch. Weathersby '184 has problems common with many other pick holders and pick dispensers. In one embodiment, it would take two hands to dispense a pick: one hand would work the selection switch and the other hand would gather the pick. In the other embodiment, Weathersby '184 has the same problems as other spring-loaded pick-holders. First, the pick holder will respond to picks differently, based on the surface texture, thickness, and material of the pick. Many musicians have a wide variety of picks, with the picks coming in variety of hardnesses, thicknesses, and surface finishes. Spring loaded pick holders jam-up when loaded with textured picks. Additionally, thicker picks tend to be difficult to remove from spring loaded pick holders. Lastly, due to the varying thicknesses of picks, the spring loaded holders that stack the picks, such as Weathersby '184, tend to dispense more than one pick when filled with thinner picks.

A number of musicians use picks that are intended to be easily retained on the finger, such as U.S. Pat. No. 8,492,630, by named inventor Wonnacott, entitled, "Musical instrument pick with replaceable strap" ("Wonnacott '630"). Wonnacott '630 discloses a pick with two slots, through which a removable strap may pass. The strap is used to secure the pick to the musician's finger. Wonnacott '630 has several problems, common with this kind of arrangement: it requires the musician to hold the pick in a different way than what most guitar players are used to; it does not fix the broken pick problem (and, in fact, may make it worse); and it does not present a new pick an a quick and easy manner. In addition to the strap disclosed by Wonnacott '630, the prior art teaches elastic bands, strings, rings, and other ways of securing the pick to the guitar player's hand.

A number of musicians use picks that have sticky or high friction surfaces, such as U.S. Pat. No. 8,076,560, by named inventor McKee, entitled, "Musical instrument pick grip" ("McKee '560"). McKee '560 teaches an abrasive disc that can be adhered to either or both sides of a pick. McKee '560 does not solve the inherent problem in playing a guitar: players crack or drop the pick. Making the pick rough or sticky is a marginal solution, at best.

Clearly, none of the prior art offers an ideal solution for a presenting a ready pick to a musician using a guitar or other plucked instrument. The inventor's own prior patent, U.S. Pat. No. 8,742,239, by named inventor Storck, entitled, "Easy access flexible container and pick holder for stringed musical instrument picks," ("Storck '239") cures most of the prior art problems. After repeated use, the pick-holding slots of Storck '239 begin to stretch, allowing picks to unintentionally come loose. The present invention attempts to overcome this problem, by offering a guitar pick that will easy attach to a strap or belt, making a pick holder unnecessary.

SUMMARY OF THE INVENTION

The present invention is a pick with an integral strap holder for use with musical instruments that are plucked. The present invention may take on a variety of embodiments, but all have the inherent core that they have a slot or other feature that will temporarily allow the pick to be attached to a belt or strap.

In one set of embodiments, the strap holder is created by making a slot in the main body of the guitar pick. The slot nearly bisects the main body of the guitar pick, creating a larger portion with the point of the guitar pick, and a smaller portion. The slot is sized to accommodate a standard fabric or leather guitar strap. The slot can be straight or curved. The slot can have teeth to assist in retaining a guitar strap. The slot can have a kiss cut, or region of thinned material between the slot and the nearest edge of the guitar pick. A kiss cut would allow the smaller portion of the main body to break free from the rest of the guitar pick, to insure that the pick does not bind on a guitar strap.

In another set of embodiments, a main portion of a guitar pick can be connected to a breakaway portion that can be attached to a guitar strap. In the example used herein, a shaft extends from the main body of the guitar pick. The shaft has two extensions, opposed to, and in proximity, with one another. The gap between the two extensions is sized to accommodate a standard guitar strap. Teeth can be added between the two extensions to improve the physical attachment to the strap. The breakaway portion can include a kiss cut, allowing the breakaway portion to easily separate from the main body of the pick. In this way, this set of embodiments insures that the pick does not bind on the guitar strap.

BRIEF DESCRIPTION OF THE DRAWINGS

There are fifteen relevant drawings.

DETAILED DESCRIPTION OF THE PREFERRED EMBODIMENTS

The following description represents the inventors' current preferred embodiments. The description is not meant to limit the invention, but rather to illustrate its general principles of operation. Examples are illustrated with the accompanying drawings. A variety of drawings are offered, showing the present invention with configurations for attaching a guitar pick directly to a strap, belt, or similar planar, flexible object. All of the guitar picks shown here have a thumb dimple on one side. Although this is a common feature of guitar picks, it is not a requirement for this invention, nor is a dimple on only one side a limitation of this invention. All of the guitar picks drawn in this patent are a triangular wedge. The triangular, wedge-shape of the guitar pick is not a limitation of this patent, and is merely used to highlight the differences between the standard guitar pick and the embodiments.

Figure 1:
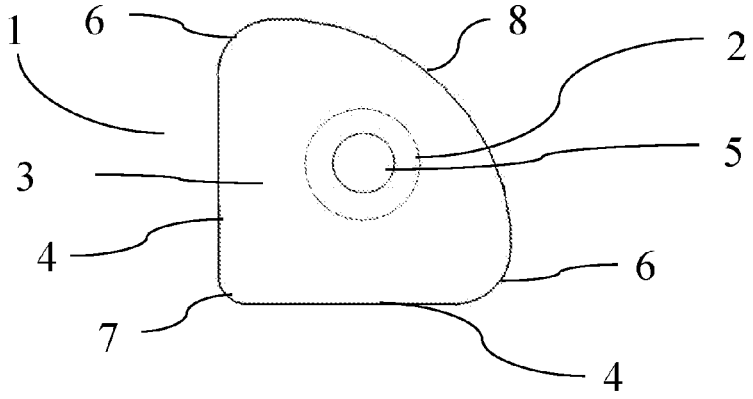
FIG. 1 is a top view of a standard guitar pick.
Figure 2:
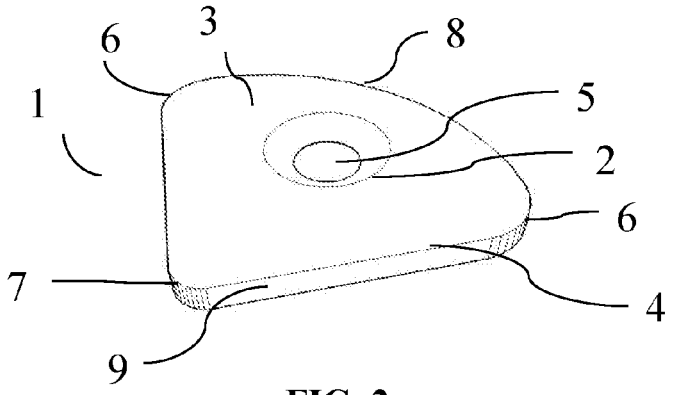
FIG. 2 is a isolation view of a standard guitar pick.
Figure 3:
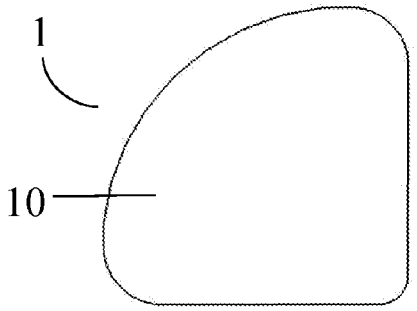
FIG. 3 is a back view of a standard guitar pick.

FIG. 1, FIG. 2, and FIG. 3 show a representative, standard guitar pick 1. The guitar pick 1 is constructed from a single piece of material, having a top surface 3, a bottom surface 10, and a variety of curved edges 8, 6, and straight edges 4. A standard guitar pick is typically triangular, tear-drop shaped, or a combination of triangular and tear-drop shaped. For the sake of this patent, all guitar picks are being drawn as a combination of triangular and tear-drop shaped. The guitar pick 1 has a dimple 5, with a dimple perimeter 2. The guitar pick 1 has a curved point 7, which is used to strum the string of a guitar or other musical instrument (not shown).

Figure 4:
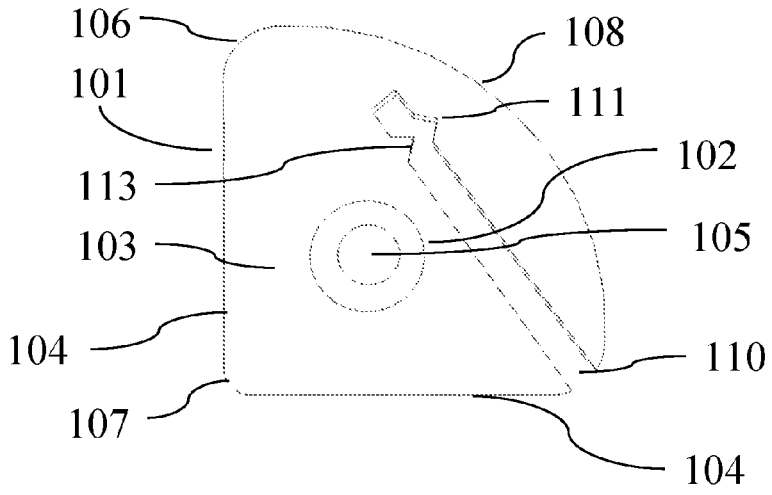
FIG. 4 is a top view of a first embodiment of the present guitar-pick invention.
Figure 5:
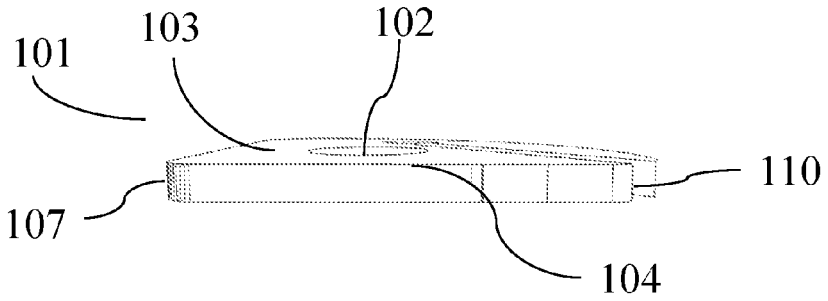
FIG. 5 is a side view of the first embodiment of the present guitar-pick invention.
Figure 6:
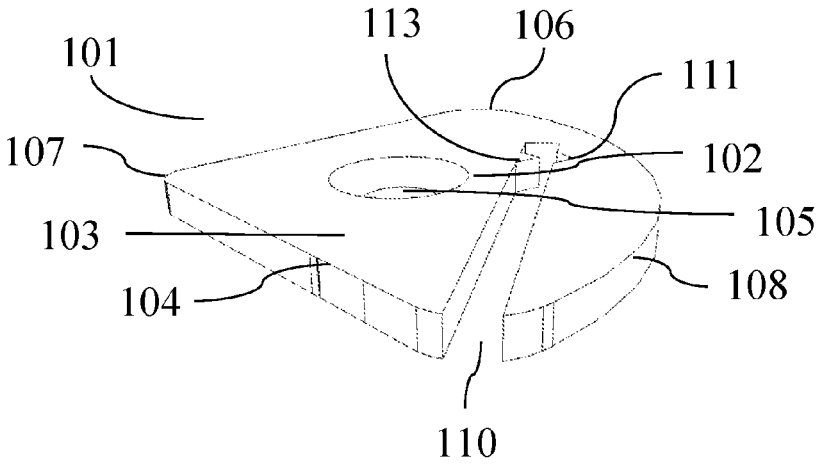
FIG. 6 is an isolation view of the first embodiment of the present guitar-pick invention.
Figure 7:
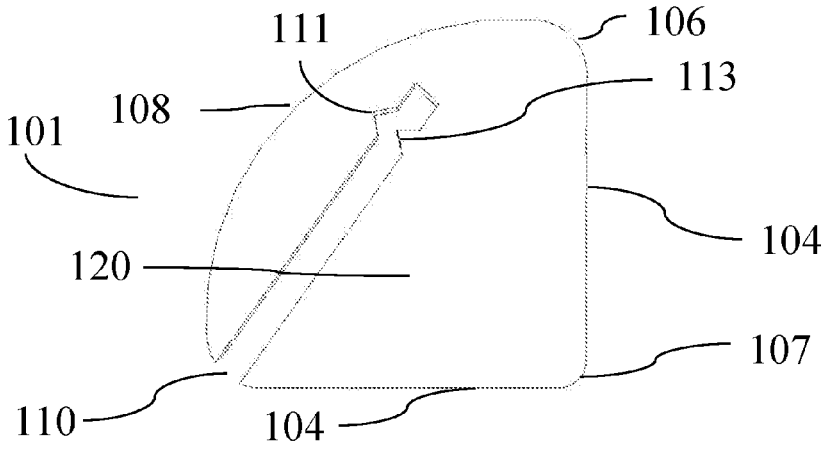
FIG. 7 is a back view of the first embodiment of the present guitar-pick invention.

FIG. 4, FIG. 5, and FIG. 6 show a first embodiment of the present guitar-pick invention, a guitar pick with integral strap holder 101. The guitar pick 101 is larger than a standard guitar pick 1. The guitar pick 101 is constructed from a single piece of material, having a top surface 103, a bottom surface 120, and a variety of curved edges 108, 106, and straight edges 104. The guitar pick 101 has a dimple 105, with a dimple perimeter 102. The guitar pick 101 has a curved point 107, which is used to strum the string of a guitar or other musical instrument (not shown). The guitar pick 101 can be made out of a variety of useful materials, including, but not limited to, polypropylene, ABS, HDPE, LDPE, bone, stone, or metal.

The guitar pick 101 has a straight slot 110, so that the guitar pick 101 can be temporarily attached to a strap, belt, or other planar, flexible material. At the inner most part of the straight slot 110, there are two teeth 111, 113, that grab and softly hold a fabric or leather strap or belt.

Figure 8:
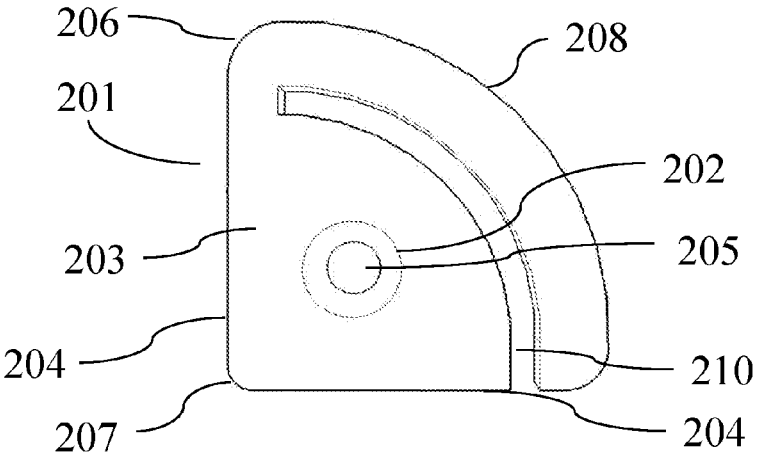
FIG. 8 is a top view of a second embodiment of the present guitar-pick invention.
Figure 9:
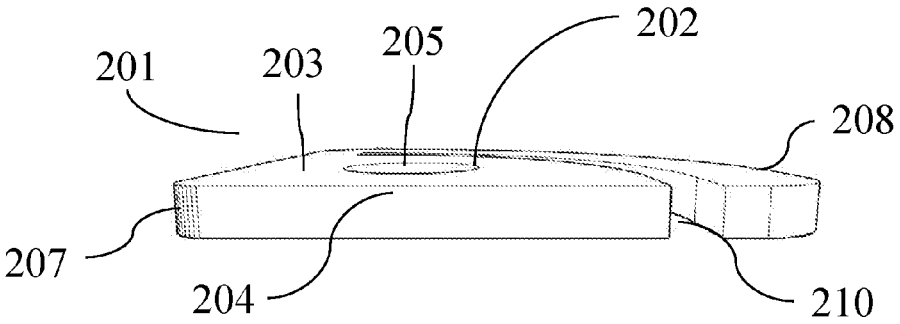
FIG. 9 is a side view of the second embodiment of the present guitar-pick invention.
Figure 10:
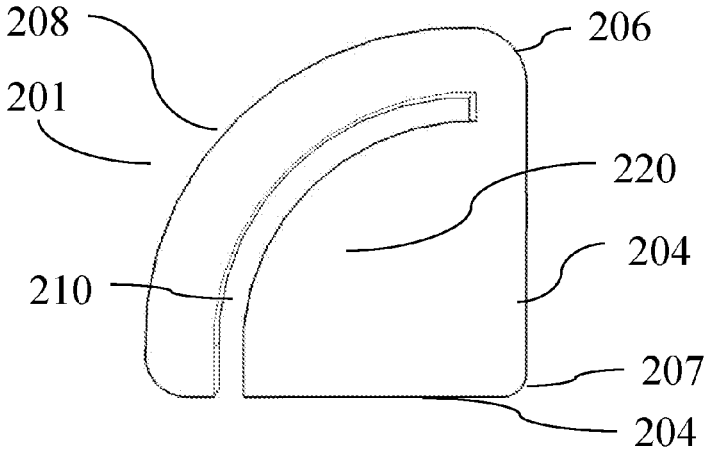
FIG. 10 is a back view of the second embodiment of the present guitar-pick invention.

FIG. 8, FIG. 9, and FIG. 10 show a second embodiment of the present guitar-pick invention, a guitar pick with integral strap holder 201. The guitar pick 201 is constructed from a single piece of material, having a top surface 203, a bottom surface 220, and a variety of curved edges 208, 206, and straight edges 204. The guitar pick 201 has a dimple 205, with a defined dimple perimeter 202. The guitar pick 201 has a curved point 207, which is used to strum the string of a guitar or other musical instrument (not shown). The guitar pick 201 can be made out of a variety of useful materials, including, but not limited to, polypropylene, ABS, HDPE, LDPE, bone, stone, or metal. The guitar pick 201 has a curved slot 210, so that the guitar pick 201 can be temporarily attached to a strap, belt, or other planar, flexible material.

Figure 11:
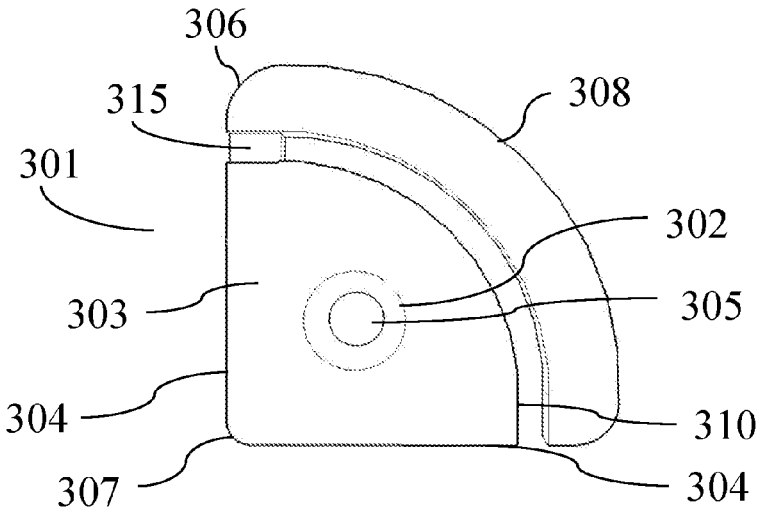
FIG. 11 is a top view of a third embodiment of the present guitar-pick invention.
Figure 12:
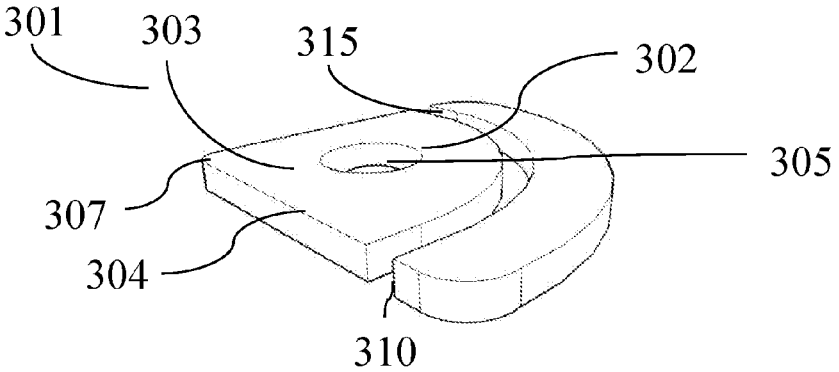
FIG. 12 is a side view of a third embodiment of the present guitar-pick invention.

FIG. 11 and FIG. 12 show a third embodiment of the present guitar-pick invention, a guitar pick with integral strap holder 301. The guitar pick 301 is constructed from a single piece of material, having a top surface 303, a bottom surface (not shown), and a variety of curved edges 308, 306, and straight edges 304. The guitar pick 301 has a dimple 305, with a defined dimple perimeter 302. The guitar pick 301 has a curved point 307, which is used to strum the string of a guitar or other musical instrument (not shown). The guitar pick 301 can be made out of a variety of useful materials, including, but not limited to, polypropylene, ABS, HDPE, LDPE, bone, stone, or metal.

The guitar pick 301 has a curved slot 310, so that the guitar pick 301 can be temporarily attached to a strap, belt, or other planar, flexible material. The curved slot 310 extends most of the way through the guitar pick 301, and is held on by a thinned piece of material, called a kiss cut 315. The curved slot 310 and kiss cut 315 are designed to break easily when the user pulls the guitar pick 301. In this way, the third embodiment 310 removes the possibility of the guitar pick 301 snagging or getting stuck when the musician pulls it.

Figure 13:
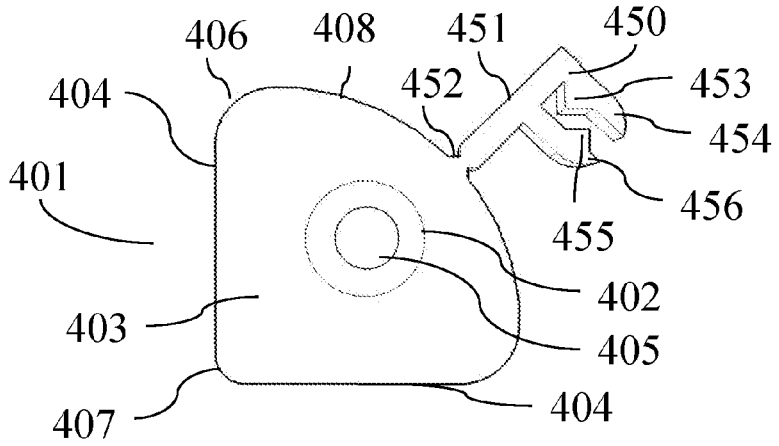
FIG. 13 is a top view of a fourth embodiment of the present guitar-pick invention.
Figure 14:
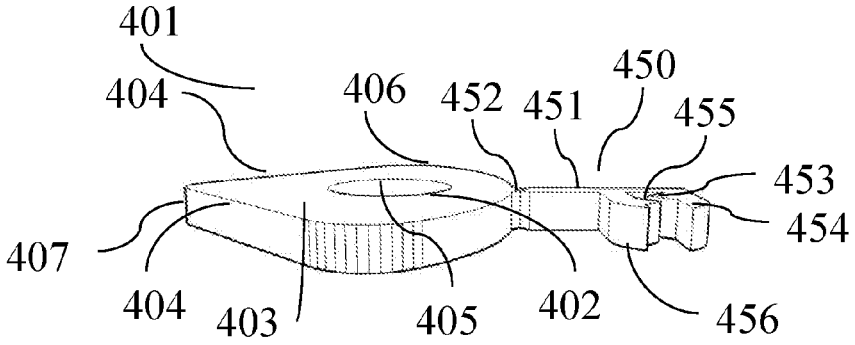
FIG. 14 is an elevated side view of the fourth embodiment of the present guitar-pick invention.
Figure 15:
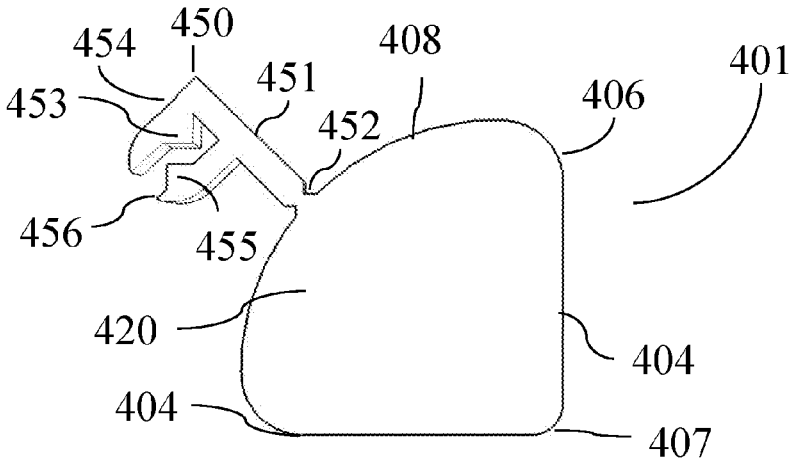
FIG. 15 is a back view of the fourth embodiment of the present guitar-pick invention.

FIG. 13, FIG. 14, and FIG. 15 show a fourth embodiment of the present guitar-pick invention, a guitar pick with integral strap holder 401. The guitar pick 401 is constructed from a single piece of material, having a top surface 403, a bottom surface 420, and a variety of curved edges 408, 406, and straight edges 404. The guitar pick 401 has a dimple 405, with a defined dimple perimeter 402. The guitar pick 401 has a curved point 407, which is used to strum the string of a guitar or other musical instrument (not shown). The guitar pick 401 can be made out of a variety of useful materials, including, but not limited to, polypropylene, ABS, HDPE, LDPE, bone, stone, or metal.

The guitar pick 401 has a breakaway shaft assembly 450. The breakaway shaft assembly 450 has a shaft 451, that connects the breakaway shaft assembly 450 to the main portion 403, 420, 404, 406, 407, 408 of the guitar pick 401. At the top of the shaft 451 are an upper extension 454, and a lower extension 456, in proximity with, and disposed in opposition to, one another. The upper extension 454 has a tooth 453 on the surface facing the lower extension 456; likewise, the lower extension has a tooth 455 on the surface facing the upper extension 454. The gap between the upper extension 454 and the lower extension 456, in which the teeth are present 455, 453, is designed to allow the guitar pick to be temporarily fastened to a strap or belt (not shown). At the base of the shaft 451 are two kiss-cuts 452. The kiss-cuts 452 are designed to make the shaft 451 breakaway from the main portion 403, 420, 404, 406, 407, 408 of the guitar pick 401, when the user pulls the guitar pick 401. This embodiment is designed to have the guitar pick 401 break-free from the breakaway shaft assembly 450, prior to use.

I claim:

1. A guitar pick with integral strap holder comprised of a single piece of solid material with at least a front surface and a bottom surface, separated by and connected with a plurality of edges; wherein a slot passes orthogonally through the front surface, the bottom surface, and the bulk of solid material separating the two surfaces; said slot originating at an edge and continuing partially through the front surface, the bottom surface, and the solid material of the guitar pick; said slot being sized to accommodate a standard fabric or leather guitar strap.

2. The guitar pick with integral strap holder in claim 1, wherein the material is polypropylene, ABS, HDPE, LDPE, bone, stone, or metal.

3. The guitar pick with integral strap holder in claim 2, wherein the slot is linear.

4. The guitar pick with integral strap holder in claim 3, wherein the slot has one or more protrusions, called teeth, designed to engage with a standard fabric or leather guitar strap.

5. The guitar pick with integral strap holder in claim 2, wherein the slot is curved.

6. The guitar pick with integral strap holder in claim 5, wherein the slot has one or more protrusions, called teeth, designed to engage with a standard fabric or leather guitar strap.

7. The guitar pick with integral strap holder in claim 5, wherein the slot extends laterally almost completely through the top and bottom surface, nearly bi-secting the guitar pick with integral strap holder into two pieces.

8. The guitar pick with integral strap holder in claim 7, wherein the material of the guitar pick is significantly thinner in a region between the termination of the slot and the nearest edge to the slot termination point.

9. A guitar pick with integral strap holder comprised of a single piece of solid material with a main body comprised of at least a front surface and a bottom surface, separated by and connected with a plurality of edges; wherein a breakaway shaft extends from the main body, creating a connected end of the breakaway shaft, and a free-end of the breakaway shaft; wherein, extending from the free-end of the breakaway shaft, are two extensions, separated by a gap and opposed to one another; wherein the gap between the two extensions is sized to accommodate a standard fabric or leather guitar strap.

10. The guitar pick with integral strap holder in claim 9, wherein the material is polypropylene, ABS, HDPE, LDPE, bone, stone, or metal.

11. The guitar pick with integral strap holder in claim 10, wherein each extension has at least one surface opposed to, and in proximity with, the other extension, called a facing surface.

12. The guitar pick with integral strap holder in claim 11, wherein each facing surface has at least one tooth, designed to engage with a standard fabric or leather guitar strap.

13. The guitar pick with integral strap holder in claim 12, wherein connected end of the breakaway shaft has a kiss-cut in which the material at the connected end of the breakaway shaft is substantially thinner than the rest of the breakaway shaft.

* * * * *